US008262169B2

(12) United States Patent
Hill

(10) Patent No.: US 8,262,169 B2
(45) Date of Patent: Sep. 11, 2012

(54) RACK BAR HAULAGE SYSTEM WITH AN IMPROVED RACKBAR TO LINE PAN CONNECTION

(75) Inventor: Nigel Hill, Eckington (GB)

(73) Assignee: Joy MM Delaware, Inc., Wilmington, DE (US)

( * ) Notice: Subject to any disclaimer, the term of this patent is extended or adjusted under 35 U.S.C. 154(b) by 373 days.

(21) Appl. No.: 12/692,180

(22) Filed: Jan. 22, 2010

(65) Prior Publication Data

US 2011/0181096 A1 Jul. 28, 2011

(51) Int. Cl.
*E21C 29/00* (2006.01)

(52) U.S. Cl. ..... 299/42

(58) Field of Classification Search ..... 299/42
See application file for complete search history.

(56) References Cited

U.S. PATENT DOCUMENTS 4,461,512 A * 7/1984 Sirotin et al. ..... 299/42
4,889,393 A * 12/1989 Schupphaus ..... 299/42

FOREIGN PATENT DOCUMENTS

GB 2094866 9/1982
GB 2125858 3/1984
GB 2127066 4/1984
GB 2195133 3/1988
GB 2198465 6/1988

OTHER PUBLICATIONS

GB 1101000.6 Intellectual Property Office Search Report dated May 12, 2011 (3 pages).

* cited by examiner

*Primary Examiner* — John Kreck
(74) *Attorney, Agent, or Firm* — Michael Best & Friedrich LLP

(57) ABSTRACT

A rack bar haulage system forms part of a drive system for moving the mining machine along a conveyor including a plurality of conveyor pans. The pans are arranged end to end, and the rack bar haulage system includes a plurality of rack bars, each rack bar end including a pillar portion extending downwardly. One rack bar is adapted to be mounted adjacent an end of a line pan, and another rack bar is adapted to be mounted adjacent the adjacent end of the adjacent line pan. The haulage system also includes a chain-link, the chain-link surrounding and engaging the two adjacent pillar portions on the ends of the one rack bar and the adjacent other rack bar. The chain-link is adapted to extend over the adjacent ends of the line pans. The haulage system also includes a clog for receiving the rack bar, the clog including an extension that engages the chain-link and traps the chain link between the extension and the rack bar.

6 Claims, 6 Drawing Sheets

RACK BAR HAULAGE SYSTEM WITH AN IMPROVED RACKBAR TO LINE PAN CONNECTION

BACKGROUND

This disclosure relates to rack bar haulage systems and the means by which the rack bars are secured and retained to armor face conveyors, in particular, though not necessarily exclusively, for underground longwall mining.

Longwall conveyors normally operate with a powered coal-cutting machine, a shearer that is mounted onto the face conveyor. The shearer hauls itself along the face conveyor in both directions by means of a haulage system. A rack bar haulage systems comprise a series of rack bars pinned to support brackets, called clogs, welded to the individual armor face conveyor elements, the line pan. The shearer engages with the racks via a shoe that permits free movement in the direction of shearer travel only. The shoe also houses a drive sprocket that engages the rack teeth to provide the required haulage load to cut the mined material. The shearer drive gear wheel meshes with uniformly spaced horizontal teeth extending between two spaced apart cheek plates to form the rack bar.

All rack systems must withstand shearer haulage forces in various directions and their retention methods must cope with the tendency of the shearer shoe to bulldoze material in front of it as it passes along the conveyor.

In conventional longwall mining, as illustrated in FIGS. 1-2 taken from Lanfermann et al U.S. Pat. No. 4,155,600, a drum cutter mining machine 1 is traversed along a face conveyor 2 by means of a driving wheel 3 secured to a longwall shearer 4. The driving wheel 3 meshes with a gearwheel or drive sprocket 5 that is rotatably supported on the machine frame 6 forming part of the drum cutter-mining machine. The teeth of the drive sprocket 5 mesh with rack gear teeth of a rack bar or device 7.

As illustrated in FIG. 2, the face conveyor 2 is made up of a plurality of conveyor pan sections or line pans 9 joined together end-to-end by connecting elements 8. By means of these connecting elements, the conveyor pan sections are maintained movable with respect to each other so that the conveyor pan sections are adaptable to characteristics of the mine floor. The individual conveyor pan sections are connected together by the connecting elements 8 to provide not only limited mobility with respect to each other in the horizontal direction of the conveyor 2, but also to provide vertical or horizontal angling of one conveyor pan section with respect to another when set on the mine floor. The rack device 7 that is mounted onto the face conveyor 2 undergoes the same horizontal motions as the conveyor pan sections. When the face conveyor is shifted, the rack device also undergoes the same vertical angular motions which the conveyor pan sections undergo particularly when it is desired to work undulating portions of a mine seam. The rack device 7 includes a plurality of elongated rack bars consisting of movable rack bars 7*a* and immovable rack bars 7*b*. Holders or clogs 10 that are directly or indirectly connected to the face conveyor 2 support all the rack bars. Connecting bolts 11 are used to join the individual rack bars to the clogs 10.

The movable and immovable rack bars 7*a* and 7*b*, respectively, of the rack device 7 are provided at both ends of each segment with a nose-shaped extension 12 which projects downwardly. This extension includes a bore for accommodating a connecting bolt 11 forming a pivot shaft. As shown in FIG. 1, the movable rack bars 7*a* bridge a joint A between the conveyor pan sections. The movable rack bars 7*a* are mounted onto the same two holders 10 which are used to mount one end of adjacent immovable rack bars 7*b*. These immovable rack bars are each entirely disposed to extend along a single conveyor pan section. Thus, two rack clogs 10 are secured at spaced-apart locations to a conveyor pan section. Each immovable rack bar 7*b* is secured by connecting bolts or pins 11 at its opposite ends to the two rack holders which additionally support the adjacent ends of movable rack bars.

Each of the clogs 10 is provided with a slot 13 located on one-half of the holders that is nearest the joint between the conveyor pan sections. The slots 13 in the clogs 10 extend in a direction corresponding to the longitudinal orientation of the face conveyor. The connecting pins 11 extend through the slots and provide the associated movable rack bar 7*a* with adequate mobility with respect to the face conveyor. The immovable rack bars 7*b* are fixed with respect to the face conveyor 2 by the connecting bolts 11 which retain these rack bars by extending through bores 13' formed in the remaining half of the holders 10. Each bore 13' corresponds to the diameter of the pin 11. The pin 11 passes through a hole 50 in the nose extension 12 to secure the rack bar 7 in the clog 10.

Thus, it is common to have two rack bars 7 per line pan 9. One rack bar 7*b* is fixed in the center of the line pan 9, and the second rack bar 7*a* spans the joint between adjacent line pans 9. Relative articulation between line pans during the mining process can cause the inter-pan gap to vary considerably and this could cause problems as the shearer drive sprocket 5 moves from the fixed rack bar 7*b* to the inter-pan rack bar 7*a*, if the inter-pan rack bar is firmly pinned to either adjacent pan. The common solution is for the inter-pan rack bar pins 11 to be retained in slots 13 in the clogs 10 rather than holes. In this manner, the error in tooth pitch between adjacent rack bars is halved and is kinder to the shearer sprocket 5, but causes added difficulty with pin retention, as the pin 11 must be allowed to move along the slot 13.

More particularly, as shown in FIGS. 3, 4 and 5, the longwall line pans 9 include a goaf side fabrication or shield plate 14. The shield plate 14 is located adjacent the rack bar haulage system. In order to secure the rack bar 7 to the clog 10, the pin 11 is inserted into the clog 10 through an opening 15 in the shield plate 14.

The clog 10 has a width corresponding to the width of the nose-shaped extension 12, and the clog 10 defines a cavity for engaging and providing support for the rack bar 7 by receiving the nose-shaped extension 12, the cavity being defined by two spaced apart bracket sidewalls 16, and end walls 17 connecting the sidewalls 16. The clog 10 also has openings 18 through the sidewalls 16, the pin 11 being insertable through one sidewall opening 18 and being received in the other sidewall opening 18.

The pin has a head 19 that is larger than the opening through the sidewall of the clog 10, so the pin 11 cannot pass through the clog 10. In order to retain the pin 11 within the clog 10, a retainer plate 20 is dropped into the area between the head of the pin 11 and the shield plate 14. The retainer plate 20 prevents the pin 11 from coming out of the clog 10.

Thus, as shown in FIGS. 3-5, the conventional rack bars 7 are retained in the clogs 10 by the headed pins 11 that can only be assembled through the opening 15 in the goaf side shield plate 14. The headed pins 11 are themselves retained by the retainer plates 20 that locate in lugs 21 welded to the goaf side shield plate 14. The retainer plates 20 are kept in place by gravity alone, but can be made more secure with another fastener, such as a bolt or a spring pin.

The primary role of the clog 10 is to provide fixing points on the line pans 7 for the semi-flexible rack bar system along which the shearer hauls itself in order to cut material from the seam. The nature of the system is that rack bars 7 are easily replaced if damaged, but the clogs 10 cannot be repaired in a hazardous environment, as the required cutting and welding is prohibited. Hence there is a need for a strong, reliable, simple rack-clog retention assembly.

SUMMARY

It is an object of this disclosure to provide rack bar haulage system, where all rack bars are contained entirely within each line pan.

It is another object of this disclosure to provide a rack bar haulage system that is easy to disassemble for relocating the haulage system.

This disclosure thus provides a rack bar haulage system forms part of a drive system for moving the mining machine along a conveyor including a plurality of conveyor pans. The pans are arranged end to end, and the rack bar haulage system includes a plurality of rack bars, each rack bar end including a pillar portion extending downwardly. One rack bar is adapted to be mounted adjacent an end of a line pan, and another rack bar is adapted to be mounted adjacent the adjacent end of the adjacent line pan. The haulage system also includes a link element in the form of a chain-link, the chain-link surrounding and engaging the two adjacent pillar portions on the ends of the one rack bar and the adjacent other rack bar. The chain-link is adapted to extend over the adjacent ends of the line pans. The haulage system also includes a clog for receiving the rack bar, the clog including an extension that engages the chain-link and traps the chain link between the extension and the rack bar.

Figure 1:
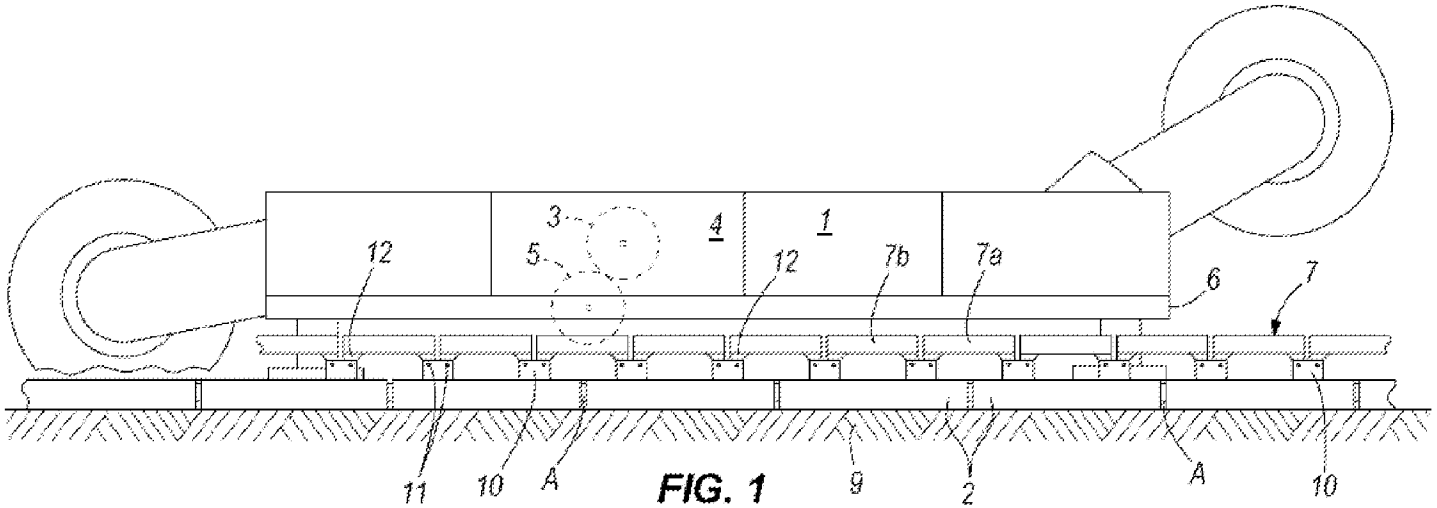
FIG. 1 PRIOR ART
FIG. 1 is a side elevation view of a prior art rack device for propelled movement by a drum-type cutter machine along a mine face.
Figure 2:
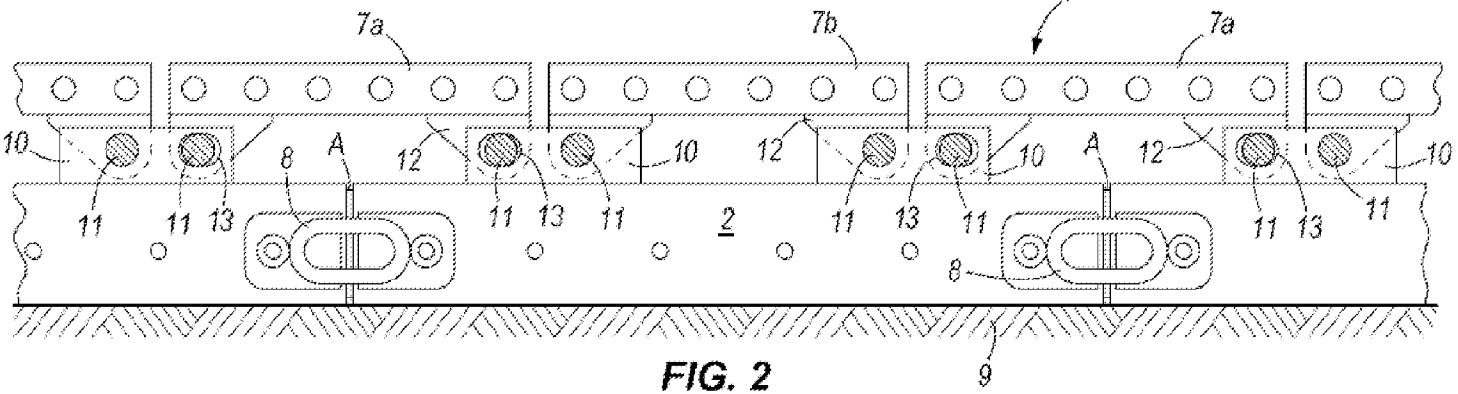
FIG. 2 PRIOR ART
FIG. 2 is an enlarged view of the rack device shown in FIG. 1 while supported by a face conveyor in its normal position.
Figure 3:
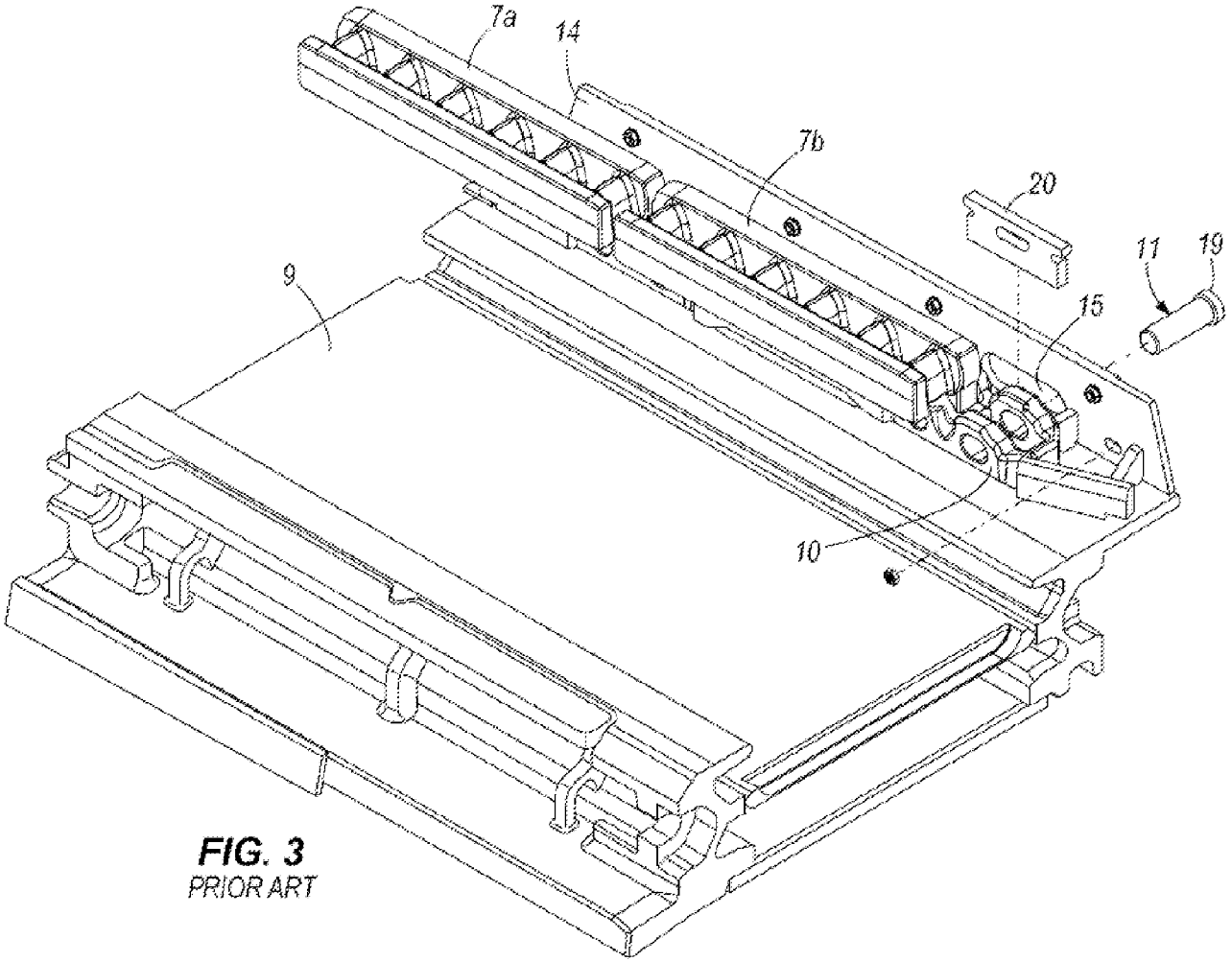
FIG. 3 PRIOR ART
FIG. 3 is an exploded perspective view of one of the line pans shown in FIG. 1.
Figure 5:
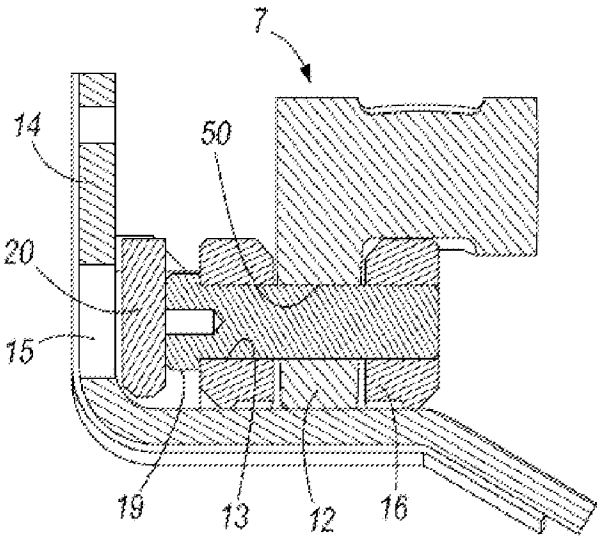
FIG. 5 PRIOR ART
FIG. 5 is a cross-sectional vertical view through the rack bar attachment to the clog shown in FIG. 4.
Figure 4:
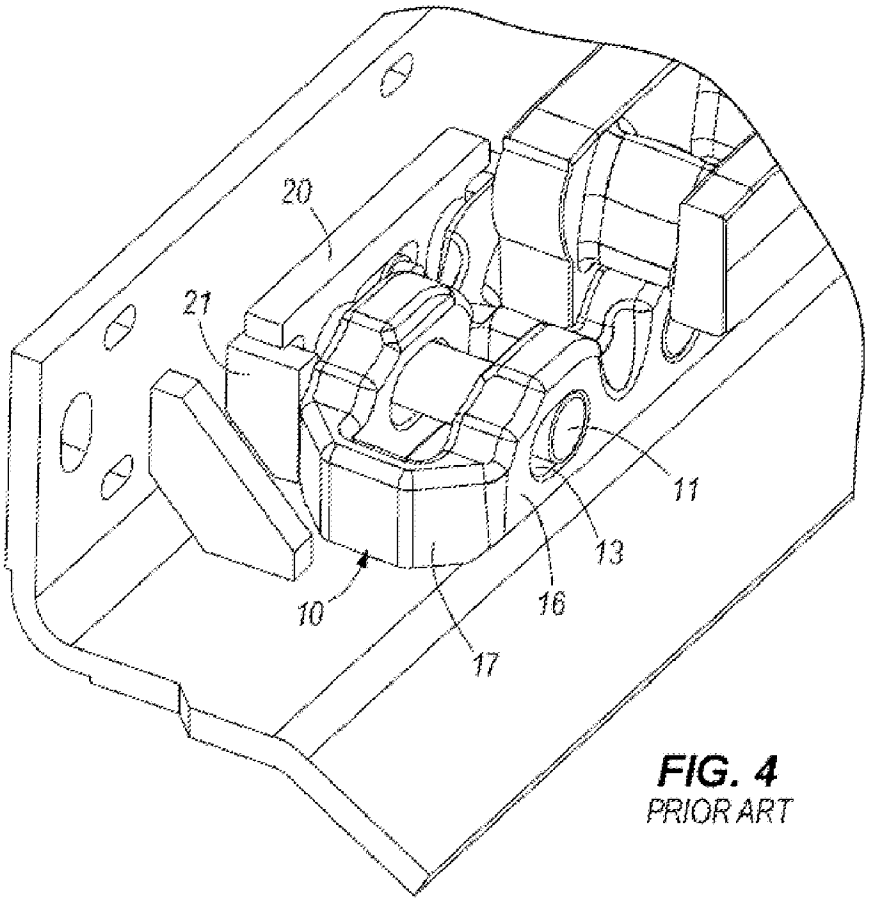
FIG. 4 PRIOR ART
FIG. 4 is a partial perspective view of the connection of one of the rack bars to a clog attached to a line pan.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

This description takes as its starting point the typical long-wall conveyor fitted with rack haulage, as described above, but where all rack bars 107 are contained entirely within each line pan 154. One rack bar 107 is fixed and the other is allowed to slide to minimize inter-rack pitch errors due to pan articulation similar to the prior art described above. The mechanism by which this is achieved differs from prior art however and is shown in FIGS. 6 through 8.

Figure 6:
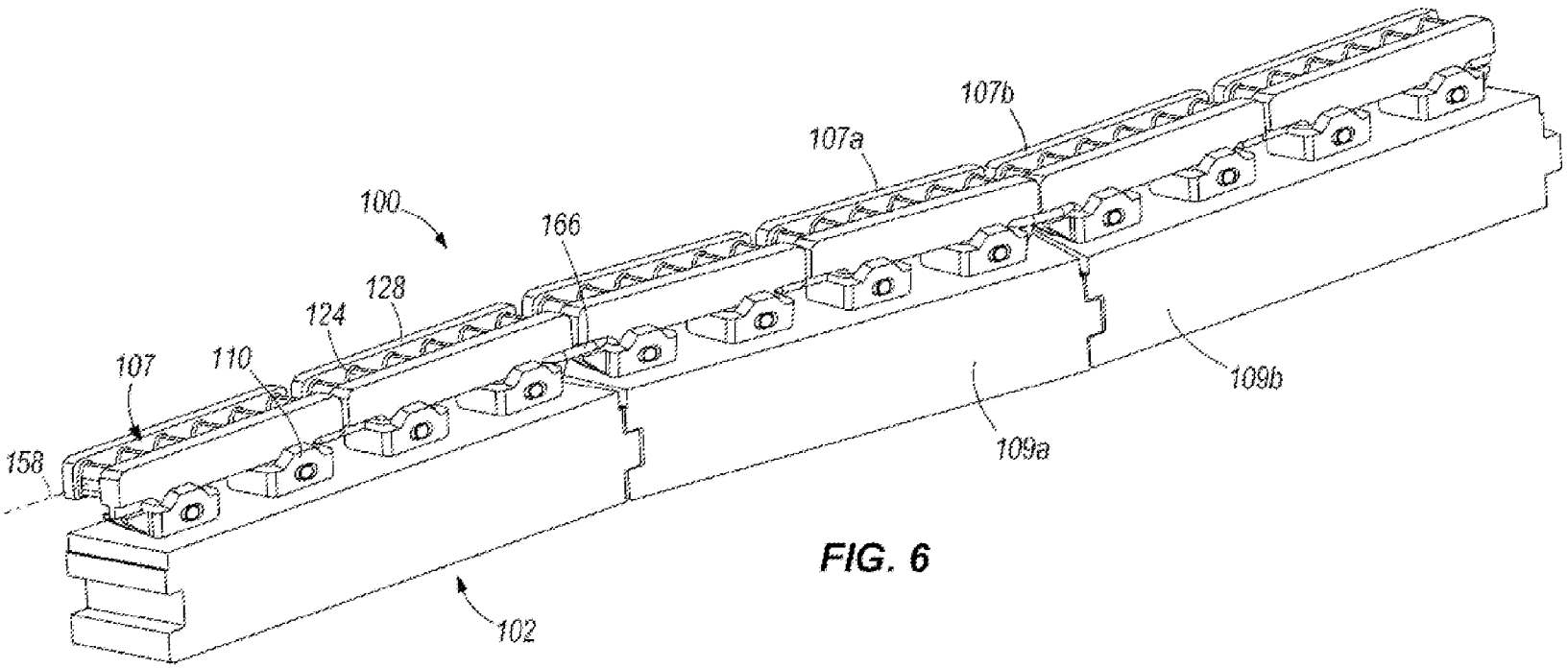
FIG. 6 is a prospective side view of a mechanism for attaching adjacent line pans.
Figure 7:
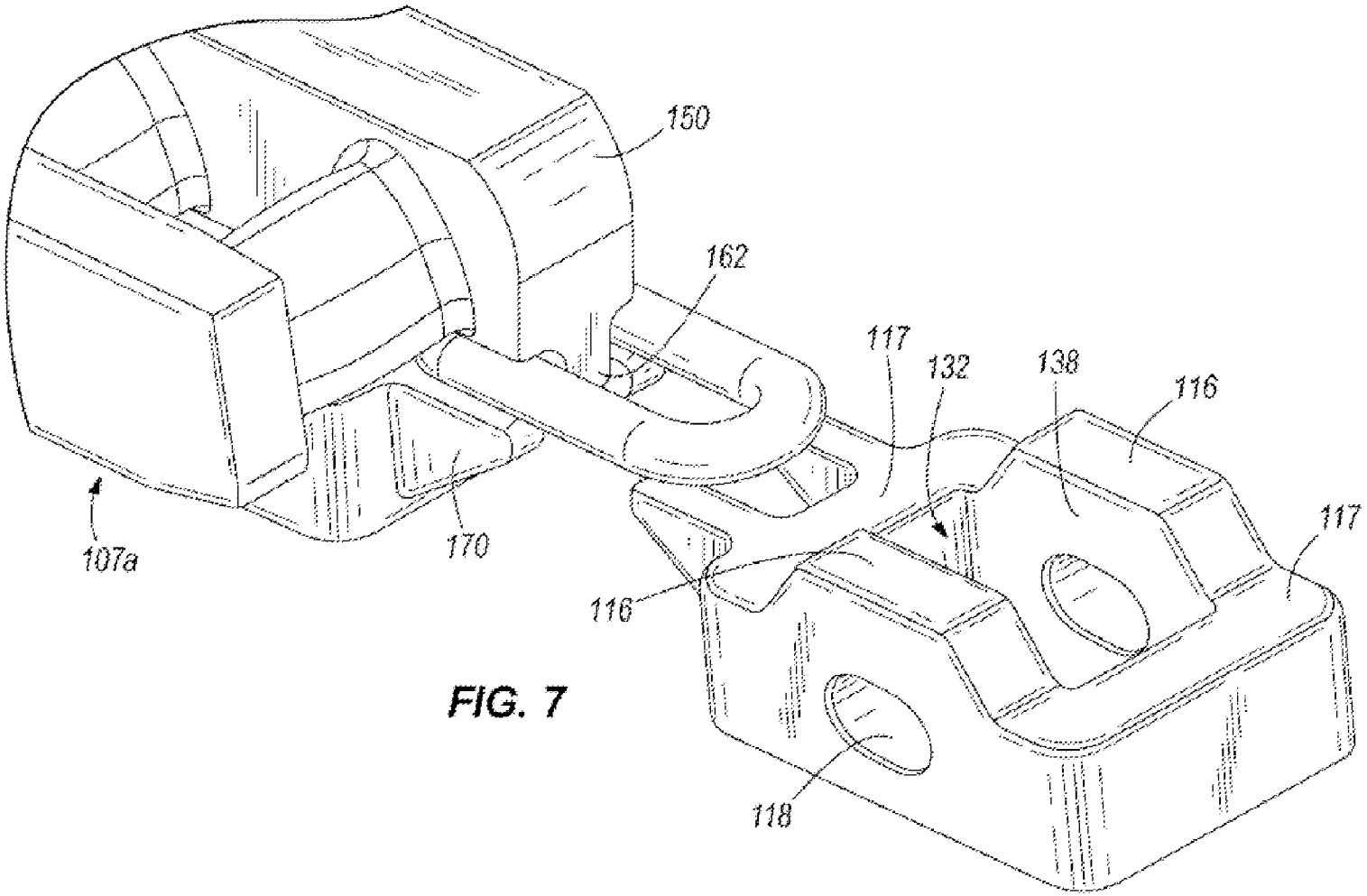
FIG. 7 is a perspective view of two adjacent clogs, with a chain link extending between the clogs, and one rack bar received in one of the clogs.
Figure 8:
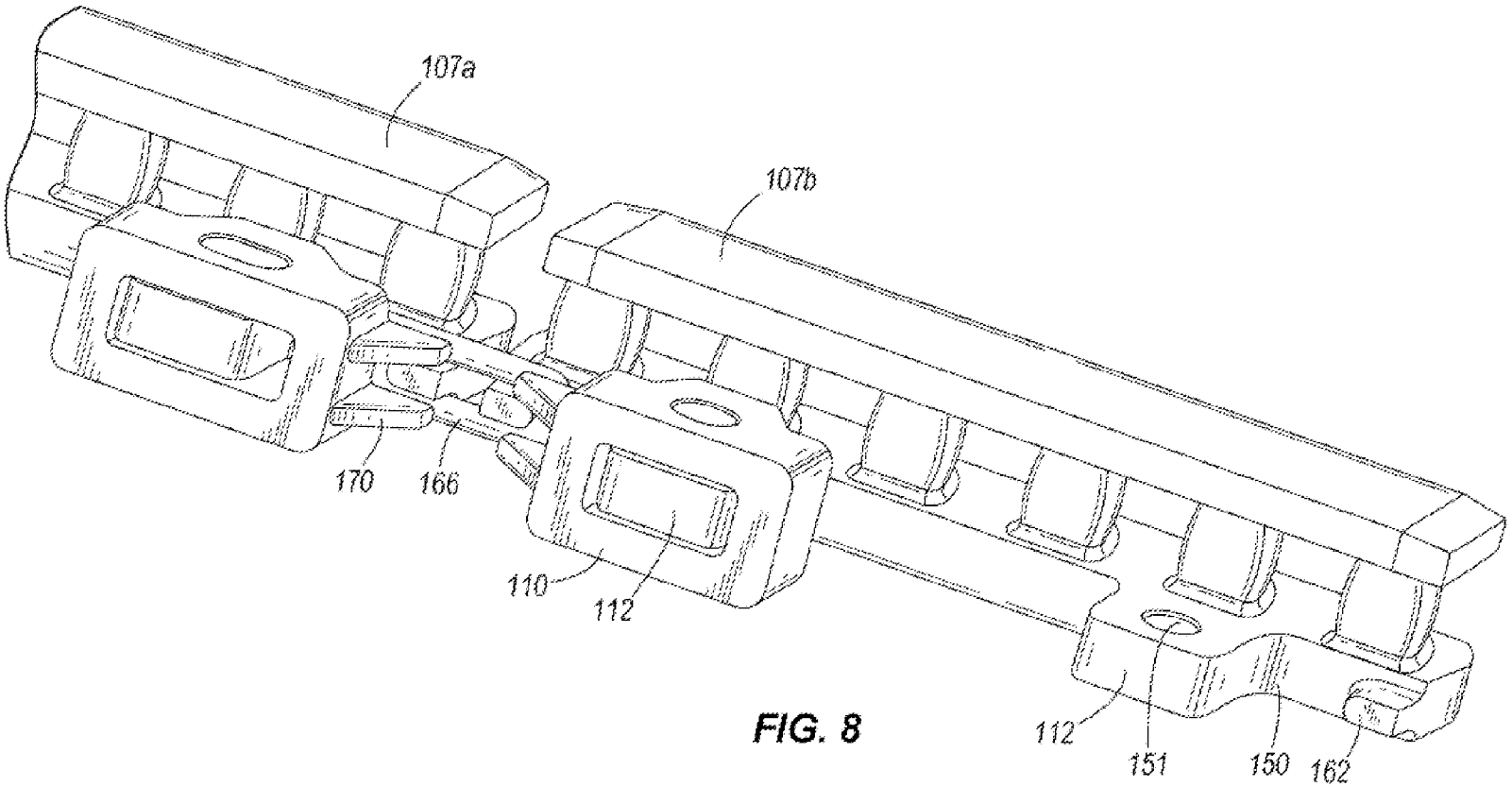
FIG. 8 is a perspective bottom view of two clogs, adjacent to one another but not attached to line pans, with the chain-link extending between the adjacent clogs, and two rack bars attached to the clogs.

FIGS. 6 through 8 illustrate a rack bar haulage system 100 forming part of a drive system for moving the mining machine 1 along a conveyor 102. The rack bar haulage system 100 includes a plurality of rack bars 107, each having spaced apart gear teeth 124 extending between cheek sections 128 at opposite sides of the rack bar 107, and a downwardly extending nose extension 112.

The conveyor 102 includes a plurality of conveyor line pans 109 arranged end to end, as shown in FIG. 6. The rack bars 107 have a longitudinal axis 158, and each rack bar has spaced apart gear teeth 124 extending between cheek sections 128 at opposite sides of the rack bar 107, and a downward nose extension 112 (see FIG. 8) adjacent and spaced apart from each rack bar end 150. Each rack bar also has a pillar portion 162 extending downwardly perpendicular to the longitudinal axis 158 of the rack bar 107. One rack bar 107*a* is mounted adjacent an end of a line pan 109*a*, and another rack bar 107*b* is mounted adjacent the adjacent end of the adjacent line pan 109*b*, as illustrated in FIG. 6.

In order to secure the rack bars 107 to the line pans 102, the haulage system 100 also includes a plurality of clogs 110. Each clog 110 has a width corresponding to the width of the nose-shaped extension 112, and the clog 110 defines a cavity 132 for engaging and providing support for the rack bar 107 by receiving the nose-shaped extension 112, the cavity 132 being defined by two spaced apart bracket sidewalls 116, and end walls 117 connecting the sidewalls 116. The clog 110 also has openings 118 and 138 through the sidewalls 116. A pin (not shown) is insertable through the sidewall opening 118 and the pin is received in the other sidewall opening 138. The pin passes through a hole 151 in the nose extension 112 to secure the rack bar 107 in the clog 110.

The haulage system also includes a link element in the form of a chain-link 166, the chain-link 166 surrounding and engaging the two adjacent pillar portions 162 on the ends of the one rack bar 107*a* and the adjacent other rack bar 107*b*, as shown in FIGS. 6 and 8. The chain-link 166 extends over the adjacent ends of the line pans 109*a* and 109*b*, thus providing flexibility in terms of relative movement between the line pans 109*a* and 109*b*. In other less preferred embodiments (not shown), the link element can assume other forms, such as a dumbbell shape, or a flat plate with openings, or a C-shape, etc.

The haulage system 100 also includes means for retaining the chain link 166 on the rack bar pillar portions 162, the means comprising an extension 170 on the clog 110 that engages the chain-link. The clog extension 170 surrounds its respective rack bar pillar portion 162. More particularly, each clog extension 170 is formed by a pair of spaced apart triangular plates welded to or cast as a part of an end wall of the clog 110.

In other less preferred embodiments, other extension shapes (not shown) could be used, or other means for retaining the chain link on the rack bar pillar portions could be used, such as a ring (not shown) secured to the end of the pillar portion, with the chain link trapped between the ring and the rack bar.

In summary, at each end 150 of the rack bar 107 is the pillar portion 162 that projects through one end of the chain-link 166. The chain-link itself is retained when the rack bar 107 is pinned to the clog 110. By this means, the inter-rack gap is controlled to a maximum when the chain link 166 is under tension, and to a minimum when the ends 150 of the rack bars 107 come into contact. This is not claimed to be superior to the prior art with regard to inter-rack pitch control, but enables that control to be achieved with rack bars 107 contained entirely within the width of the line pan. To separate pan assemblies it is only necessary to raise one end of the rack bars 107 the small amount required to remove the chain link 166 before lowering. The line pan assembly may then be transported complete with all rack bars.

Various other features of this disclosure are set forth in the following claims.

The invention claimed is:

1. A rack bar haulage system forming part of a drive system for moving the mining machine along a conveyor including a plurality of conveyor pans, the pans being arranged end to end, said rack bar haulage system including a plurality of rack bars having a longitudinal axis, each having spaced apart gear teeth extending between cheek sections at opposite sides of the rack bar, each rack bar including an end, the end including a pillar portion extending downwardly perpendicular to the longitudinal axis of the rack bar, one rack bar adapted to be mounted adjacent an end of a line pan, and another rack bar adapted to be mounted adjacent the adjacent end of the adjacent line pan, a chain-link, the chain-link surrounding and engaging the two adjacent pillar portions on the ends of the one rack bar and the adjacent other rack bar, said chain-link adapted to extend over the adjacent ends of the line pans, and means for retaining the chain link on said rack bar pillar portions.

2. A rack bar haulage system in accordance with claim 1 wherein said means comprises a clog for receiving the rack bar, the clog including an extension that engages the chain-link and traps the chain link between the extension and the rack bar.

3. A rack bar haulage system in accordance with claim 2 wherein each rack bar has a downward extension adjacent and spaced apart from the rack bar end, and wherein said clog has a width corresponding to the width of the nose-shaped extension, and the clog defines a cavity for engaging and providing support for the rack bar by receiving the downward extension.

4. A rack bar haulage system forming part of a drive system for moving the mining machine along a conveyor including a plurality of conveyor pans, the pans being arranged end to end, said rack bar haulage system including a plurality of rack bars having a longitudinal axis, each having spaced apart gear teeth extending between cheek sections at opposite sides of the rack bar, each rack bar including an end, the end including a pillar portion extending downwardly perpendicular to the longitudinal axis of the rack bar, one rack bar adapted to be mounted adjacent an end of a line pan, and another rack bar adapted to be mounted adjacent the adjacent end of the adjacent line pan, a chain-link, the chain-link surrounding and engaging the two adjacent pillar portions on the ends of the one rack bar and the adjacent other rack bar, said chain-link adapted to extend over the adjacent ends of the line pans, and a clog for receiving the rack bar, the clog including an extension that engages the chain-link and traps the chain link between the extension and the rack bar, the clog extension surrounding its respective rack bar pillar portion.

5. A rack bar haulage system in accordance with claim 4 wherein each rack bar has a downward extension adjacent and spaced apart from the rack bar end, and wherein said clog has a width corresponding to the width of the nose-shaped extension, and the clog defines a cavity for engaging and providing support for the rack bar by receiving the downward extension.

6. A rack bar haulage system forming part of a drive system for moving the mining machine along a conveyor including a plurality of conveyor pans, the pans being arranged end to end, said rack bar haulage system including a plurality of rack bars having a longitudinal axis, each having spaced apart gear teeth extending between cheek sections at opposite sides of the rack bar, each rack bar including an end, one rack bar adapted to be mounted adjacent an end of a line pan, and another rack bar adapted to be mounted adjacent the adjacent end of the adjacent line pan, a link element, said link element engaging the two adjacent ends of the one rack bar and the adjacent other rack bar, said link element adapted to extend over the adjacent ends of the line pans, and means for retaining the link element on said rack bar ends.

* * * * *